US007189102B2

(12) United States Patent
Ermert et al.

(10) Patent No.: US 7,189,102 B2
(45) Date of Patent: Mar. 13, 2007

(54) CONNECTOR ESPECIALLY FOR AN AIRBAG-IGNITION SYSTEM

(75) Inventors: Gerhard Ermert, deceased, late of Elsdorf (DE); by Angelika Ermert, legal representative, Elsdorf (DE); Goran Greguric, Zagreb (HR); Philip Vernon Little, Hertfordshire (GB); Harald Michael Lutsch, Langen (DE); Dalibor Krivohlavek, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/380,981

(22) Filed: May 1, 2006

(65) Prior Publication Data

US 2006/0286838 A1 Dec. 21, 2006

(30) Foreign Application Priority Data

May 4, 2005 (DE) ..... 10 2005 021 375

(51) Int. Cl.
*H01R 13/58* (2006.01)

(52) U.S. Cl. ..... 439/459; 439/620.05

(58) Field of Classification Search ..... 439/188, 439/620.05, 459

See application file for complete search history.

(56) References Cited

U.S. PATENT DOCUMENTS

| | | | | |
|---|---|---|---|---|
| 6,461,184 | B2 * | 10/2002 | Nimura | 439/352 |
| 6,739,913 | B2 * | 5/2004 | Hayashi | 439/620.05 |
| 2003/0228782 | A1 * | 12/2003 | Nishida et al. | 439/188 |
| 2004/0002248 | A1 | 1/2004 | Glick et al. | |
| 2004/0192098 | A1 | 9/2004 | Pavlovic et al. | |
| 2005/0020136 | A1 | 1/2005 | Johannes et al. | |

FOREIGN PATENT DOCUMENTS

| | | |
|---|---|---|
| DE | 195 11 410 A1 | 10/1996 |
| EP | 0 693 799 A2 | 1/1996 |
| EP | 0 698 947 A2 | 2/1996 |
| EP | 1 009 069 A2 | 6/2000 |
| WO | WO 99/08062 | 2/1999 |

* cited by examiner

*Primary Examiner*—Tho D. Ta
(74) *Attorney, Agent, or Firm*—Sughrue Mion, PLLC

(57) ABSTRACT

Connector for an airbag-ignition system, for inserting into an insertion chamber (3) of a mating connector (2) with contact pins (4) and detaching therefrom along a connection axis (X), comprising two contact elements (28) from an electrically conductive material, which have, respectively, a female terminal portion (29) with an outer face (29*b*), serving to connect a contact pin (4) of the mating connector (2) along the connection axis (X), a connecting portion (32) for connecting to a conductor (7) of a cable (6) and a connection portion (30), connecting the female terminal portion (29) to the connecting portion (32), an extension portion away from the connection portion (30) and following the connecting portion (32), a housing from an electrically insulating material, which has an insertion portion (9) for inserting into the insertion chamber (3) of the mating connector (2), having through openings for the contact pins (4), has an open housing portion (10) closable by a lid (11), and having for each contact element (28) at least one first holding means, by which the connection portion (30) of the contact element (28) is retained, and has second holding means at the open housing portion (10) and/or the lid (11), serving to hold at least one cable (6), and has third holding means at the open housing portion (10), on which the extension portion is retained.

19 Claims, 11 Drawing Sheets

CONNECTOR ESPECIALLY FOR AN AIRBAG-IGNITION SYSTEM

Figure 1:
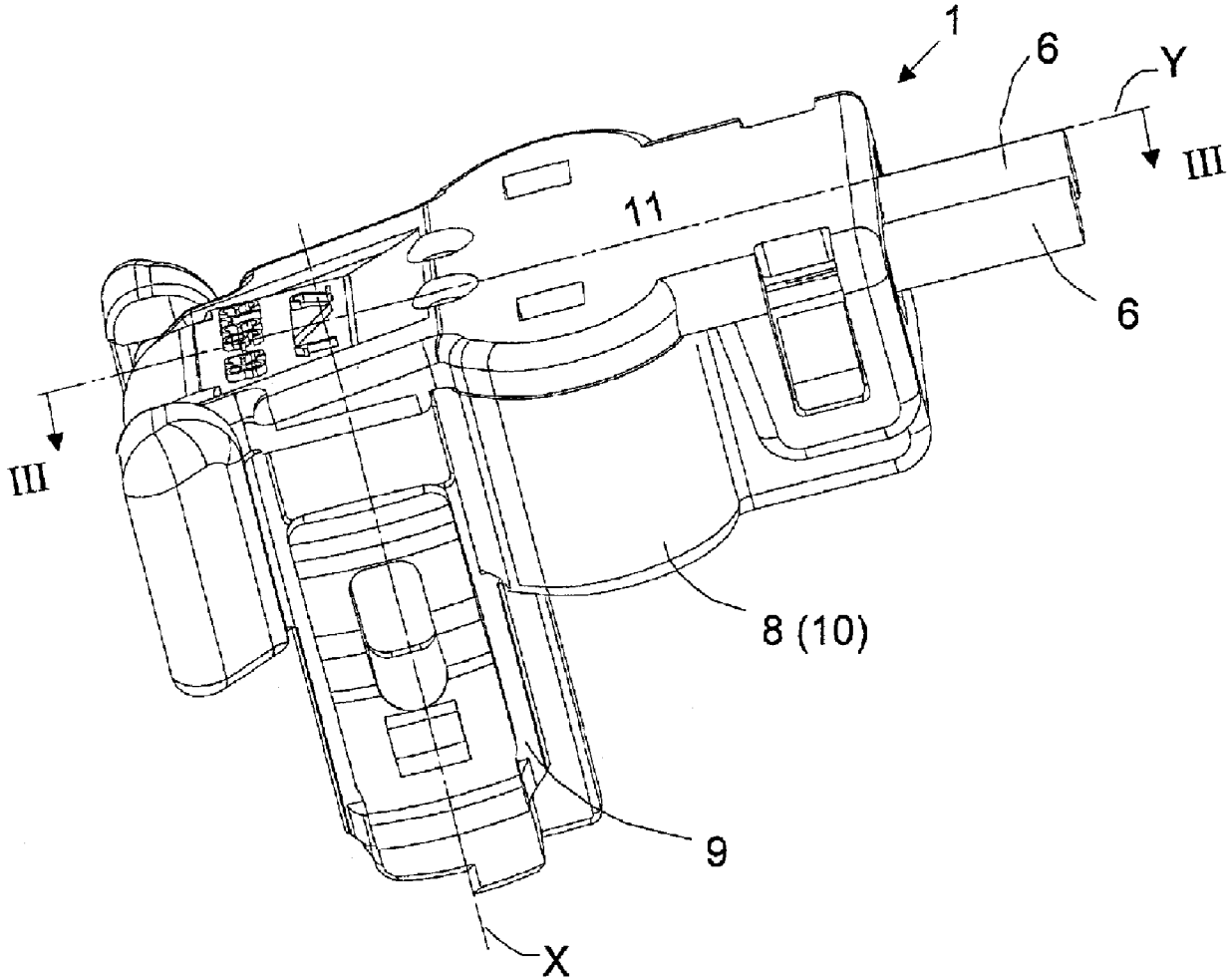

The invention relates to a connector, especially for airbag-ignition systems, for inserting into an insertion chamber of a mating connector with contact pins and for detaching therefrom along a connection axis.

US 2004/0002248 A1 describes a connector for inserting into an insertion chamber of a mating connector with contact pins and detaching therefrom along a connection axis. Two contact elements, made from an electrically conductive material, are provided. These have, respectively, a female terminal portion, forming an outer face and serving for connection to a contact pin of the mating connector along the connection axis. The two contact elements have, furthermore, respectively one connecting portion for connecting to a conductor of a cable. Additionally, a crimping portion is provided, achieving a connection to the insulation of the cable. Furthermore, a connection portion is provided, which connects the female terminal portion to the connecting portion. Each female terminal portion of the two contact elements is enclosed by a ferrite element, which, for this, has a through hole. The female terminal portion is formed such, that it abuts the wall of the through holes. Furthermore, each ferrite element is accommodated in a separate housing bore. In the transition from the female terminal portion to the connection portion an enlarged diameter portion is provided, which supports the mating ferrite element in axial direction. The housing accommodating the ferrite element and the two contact elements, has an insertion portion for inserting into the insertion chamber of the mating connector. In this insertion portion there are also the two accommodation chambers for the accommodation of respectively one ferrite element arranged to one of the contact elements. Furthermore through openings for the contact pins of the mating connector are provided in this portion. The housing comprises also an open housing portion, closable by a lid, wherein the accommodation chambers for the ferrite elements are accessible via the open housing portion, so that the ferrite elements and also the contact elements with their female terminal portions can be inserted into the accommodation chambers.

When connecting the connector to the mating connector, the contact pins of the mating connector enter through the through openings in the insertion portion of the housing into the female terminal portions. If no exact centred insertion of the connector towards the mating connector is achieved, a stronger loading of the ferrite elements can be produced for example at an inclined position.

US 2004/0192098 A1 describes a connector for inserting into an insertion chamber of a mating connector with contact pins and for detaching therefrom along a connection axis. Two contact elements from an electrically conductive material are provided, which, respectively, have a female terminal portion with an outer face. The female terminal portion serves to connect to a contact pin of the mating connector along the connection axis. Furthermore, each contact element has a connecting portion in form of a tab, serving to connect a conductor of a cable by means of soldering. Furthermore, the connecting portion has a forked portion, which tines engage in the insulation of the mating conductor. The female terminal portion is connected to the connecting portion via a connection portion, consisting of a flat material.

Further, one or more ferrite elements are provided, which have, respectively, two through holes, in which the female terminal portions with their outer faces are accommodated.

The connector comprises also a housing from an electrically insulating material, which has an insertion portion for insertion into the insertion chamber of the mating connector and forms an accommodation chamber for the ferrite element(s). Through openings for the insertion of the contact pins are provided. The housing has further an open housing portion closable by a lid and in which the contact elements are held. Furthermore, openings are provided, through which the two cables are inserted into the open portion of the housing. For this, the openings and the mating limiting faces on the lid leave between the cable and the housing or the lid, respectively, a predetermined air gap.

The invention is based on the object, to provide a connector, in which the contact elements are held, also when pulling forces act via the connected cables, so securely, that the female terminal portions remain not effected thereby, and that additionally then, when to the female terminal portions ferrite elements are arranged, an easy connection of the female terminal portions accommodated in the housing of the connector to the contact pins of the mating connector also, even with the components not being exactly centred is possible, and whereby the ferrite elements are not loaded by any active pulling forces.

This object is solved according to the invention by a connector with ferrite elements, especially for airbag-ignition systems, for insertion into an insertion chamber of a mating connector with contact pins and detaching therefrom along a connection axis comprising

- two contact elements from an electrically conductive material, which, respectively,
  - have a female terminal portion with an outer face, which serves to connect a contact pin of the mating connector along the connection axis,
  - have a connecting portion for connecting to a conductor of a cable and
  - a connection portion, connecting the female terminal portion to the connecting portion,
- a ferrite element, which
  - consists of one or more connected components,
  - has two through holes, accommodating, respectively, the female terminal portion of a contact element and leaving a gap to the outer face,
- a housing from an electrically insulating material, which
  - has an insertion portion for insertion into the insertion chamber of the mating connector, which forms an accommodation chamber for the ferrite element and which has through holes for the contact pins,
  - has an open housing portion closable by a lid and which for each contact element has at least one first holding means, by which the connection portion of the contact element is retained, and
  - has second holding means at the open housing portion and/or lid, serving to hold a cable including one or both conductors.

This object is solved according to the invention also for connectors, which are not provided with ferrite elements, by a connector for airbag-ignition systems for the insertion into an insertion chamber of a mating connector with contact pins and for detaching therefrom along a connection axis, comprising

- two contact elements from an electrically conductive material, which, respectively,
  - have a female terminal portion with an outer face, serving for connecting to a contact pin of the mating connector along the connection axis,
  - have a connecting portion for connecting to a conductor of a cable and have a connection portion, connecting the female terminal portion to the connecting portion, have away from the connection portion following the connecting portion an extension portion, a housing from an electrically insulating material, which has an insertion portion for inserting into the insertion chamber of the mating connector, having through openings for the contact pins, has an open housing portion, closable by a lid and which has for each contact element at least one first holding means, by which the connection portion of the contact element is retained, has second holding means at the open housing portion and/or lid, serving to hold at least one cable, and has third holding means at the open housing portion, at which third holding means the extension portion is retained.

As the extension portion is retained via third holding means on the open housing portion, it is achieved, that the contact element is securely held in front and behind the connecting portion, so that when connecting the connecting portion to the conductor of the mating cable the forces are absorbed advantageously and furthermore, also in this area, a secure holding is achieved, as pulling forces acting via the cable onto the contact elements can be absorbed securely and close to the area, in which the cable is connected to the mating contact element. The female terminal portion remains untouched.

Of advantage in connectors with ferrite elements is, that the female terminal portions of the two contact elements can carry out a relative movement relative to the through holes when connecting, so that the connecting procedure of the connector to the mating connector can be facilitated and furthermore no damage can be produced. When connecting the two connectors a self-alignment of the female terminals relative to the contact pins of the mating connector is achieved. The retainment of the contact elements is achieved in the area of the connection portion on the open housing portion. The lid secures in the closed condition the contact elements and furthermore secures also by means of the second holding means, which are provided on the lid and the open housing portion, the cable(s) connected to the contact elements. More than two contact elements can be provided, if necessary. The ferrite element can have a corresponding number of through holes.

For increasing the retaining force it is, further, provided, that the extension portion has at least one securing portion, which engages in a securing recess of the open housing portion assigned to it. The pulling forces, which act on the contact element, are thereby absorbed close to the entering end of the cable into the housing, so that the portion of the contact element, arranged in the direction towards the female terminal portion, is maintained essentially free of detaching forces.

Additionally to this, it is provided, that the securing portion is bent at a right angle to the extension of the extension portion, of the connection portion and of the connecting portion. Alternatively it is proposed, that the extension portion has at least one securing portion, which is formed by a tab punched from the extension portion and cranked to it, and which engages in the assembled condition a securing recess arranged below the extension portion in the open housing portion and which forms the third holding means.

Advantageous is also an embodiment, in which the first holding means and/or the third holding means are formed as holding recesses in the open housing portion. The connection portion or the extension portion are, respectively, pressed into these holding recesses. Further, the retainment can be increased such, that the connection portion and/or the extension portion grip with their side edges or claws attached thereto, respectively, into one of the two opposed wall portions, which delimit the mating holding recess, for the retainment.

It is, however, also provided, that the extension portion can be retained in third holding means of the open housing portion formed as grooves. Finally, the retainment against pulling forces can also be improved such, that wings, projecting laterally from the connection portion, abut the wall of the holding recess, accommodating the connection portion.

The connection portion comprises preferably crimping tabs, to crimp the conductor of a cable to the contact element. Advantageous, in this case, is, if the connecting portion is arranged in the open through hole of the open housing portion, so that for the crimping of the conductor of the cable to the mating contact element this opening can be used to insert a mating holder, which supports the connecting portion. It is, however, also possible, that instead of the crimping tabs or the crimping connection, resulting therefrom, a different solution for the connection between the contact element and the to be connected cable is used, for example by means of soldering or another method.

For the assembly it is advantageous, if the accommodation chamber for the accommodation of the ferrite element is accessible for the insertion of the ferrite element via the open housing portion.

For securing the two contact elements, arranged in the area of the through opening, it is provided, that the lid has three distancing projections, which engage in the through hole, of which one is arranged between the connecting portions of the two contact elements and the two others are, respectively, arranged between one connecting portion and one of the lateral walls of the through hole.

The lid itself is, preferably, retained by means of securing projections and securing arms on the housing. It is advantageous, if in the manufacture the lid is made integrally with the housing. For retaining the connector on the mating connector it is provided, that on the insertion portion of the housing elastic tabs with respectively one retaining projection are formed. These holding projections engage in a groove arranged correspondingly in the insertion chamber of the mating connector.

The lid may be used for securing all the components in the housing. For example, the lid is used, to hold the ferrite element in the accommodation chamber.

Several embodiments concerning the construction of the housing are possible. In a first embodiment the insertion portion of the housing and the open housing portion are arranged one behind the other along the connection axis. It is, however, also an arrangement possible, in which the insertion portion of the housing is angled relative to the open housing portion. Correspondingly the connection portion, the connecting portion and the extension portion of the contact elements are angled correspondingly relative to the female terminal portion.

Preferred embodiments according to the invention are shown schematically in the drawing.

It shows

Figure 2:
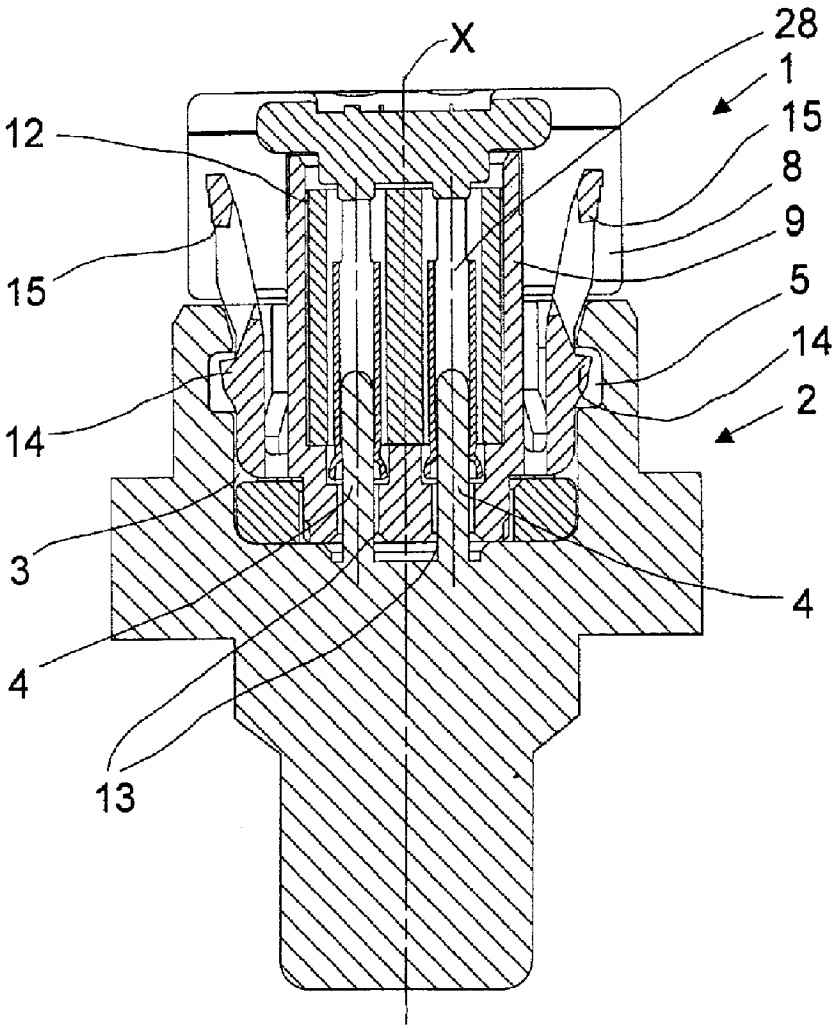
Figure 3:
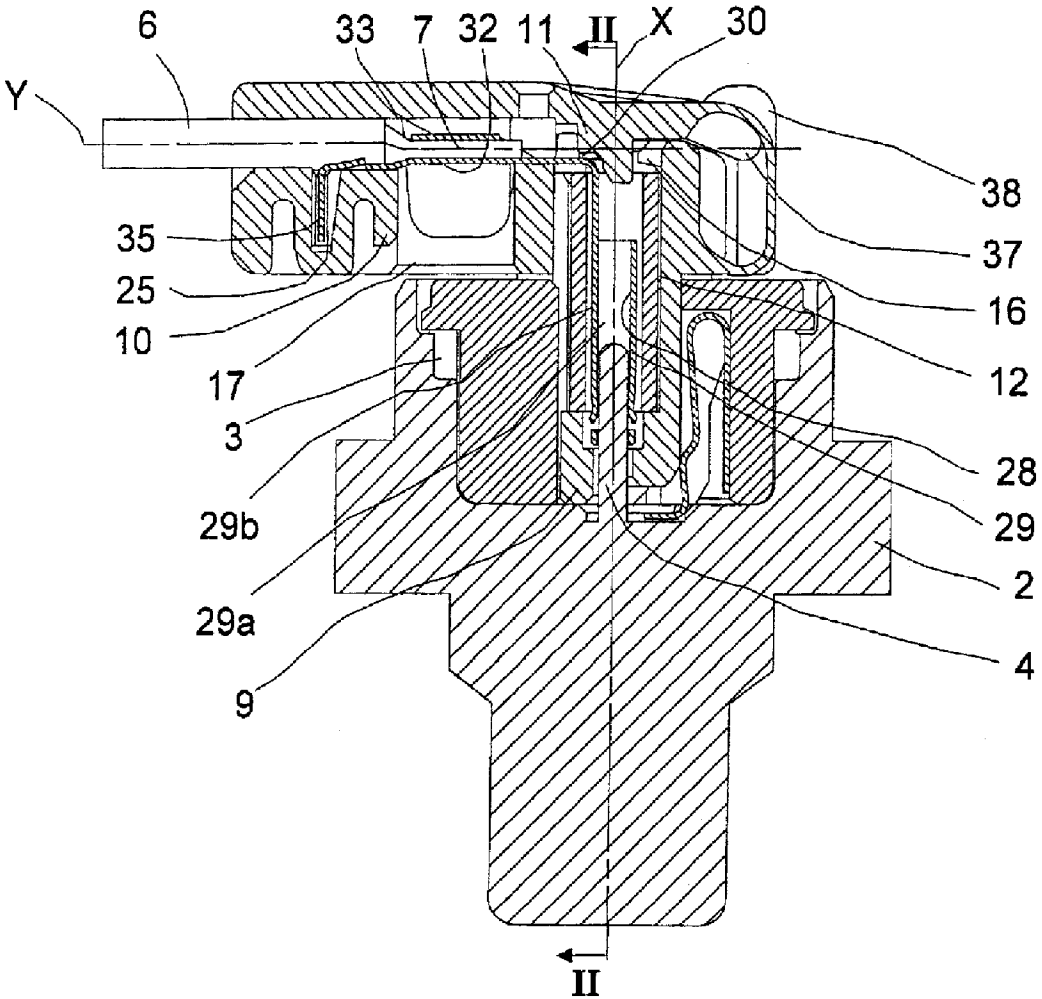
Figure 4:
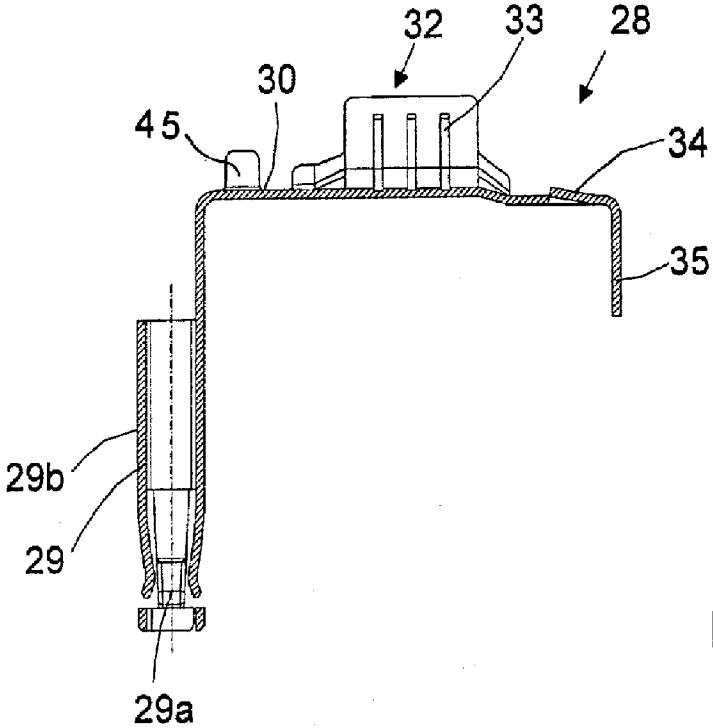
Figure 5:
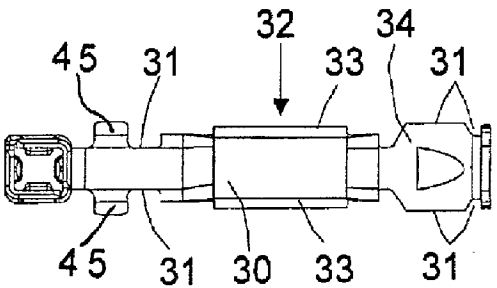
Figure 6:
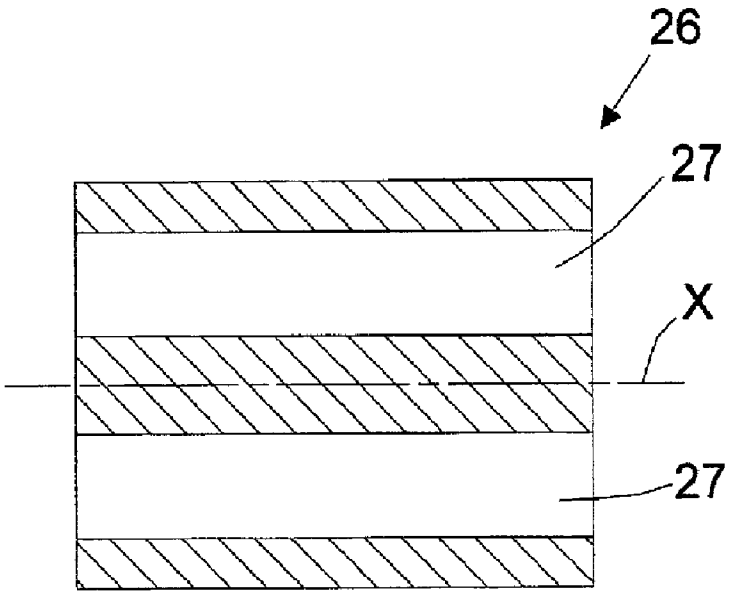
Figure 7:
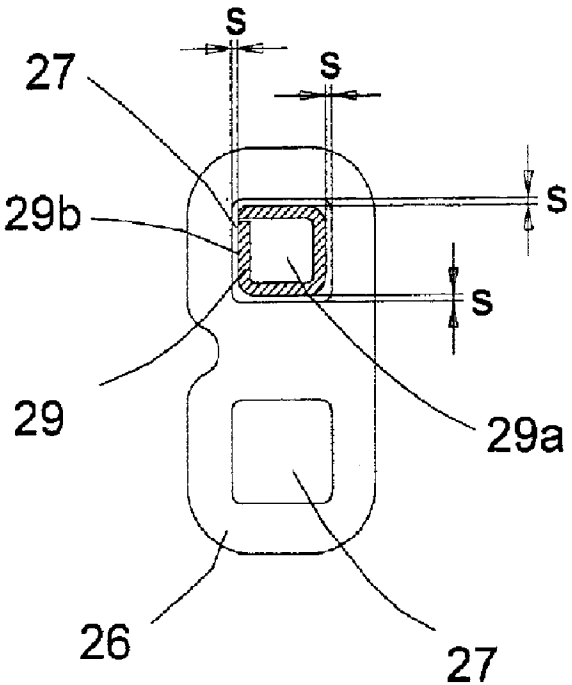
Figure 8:
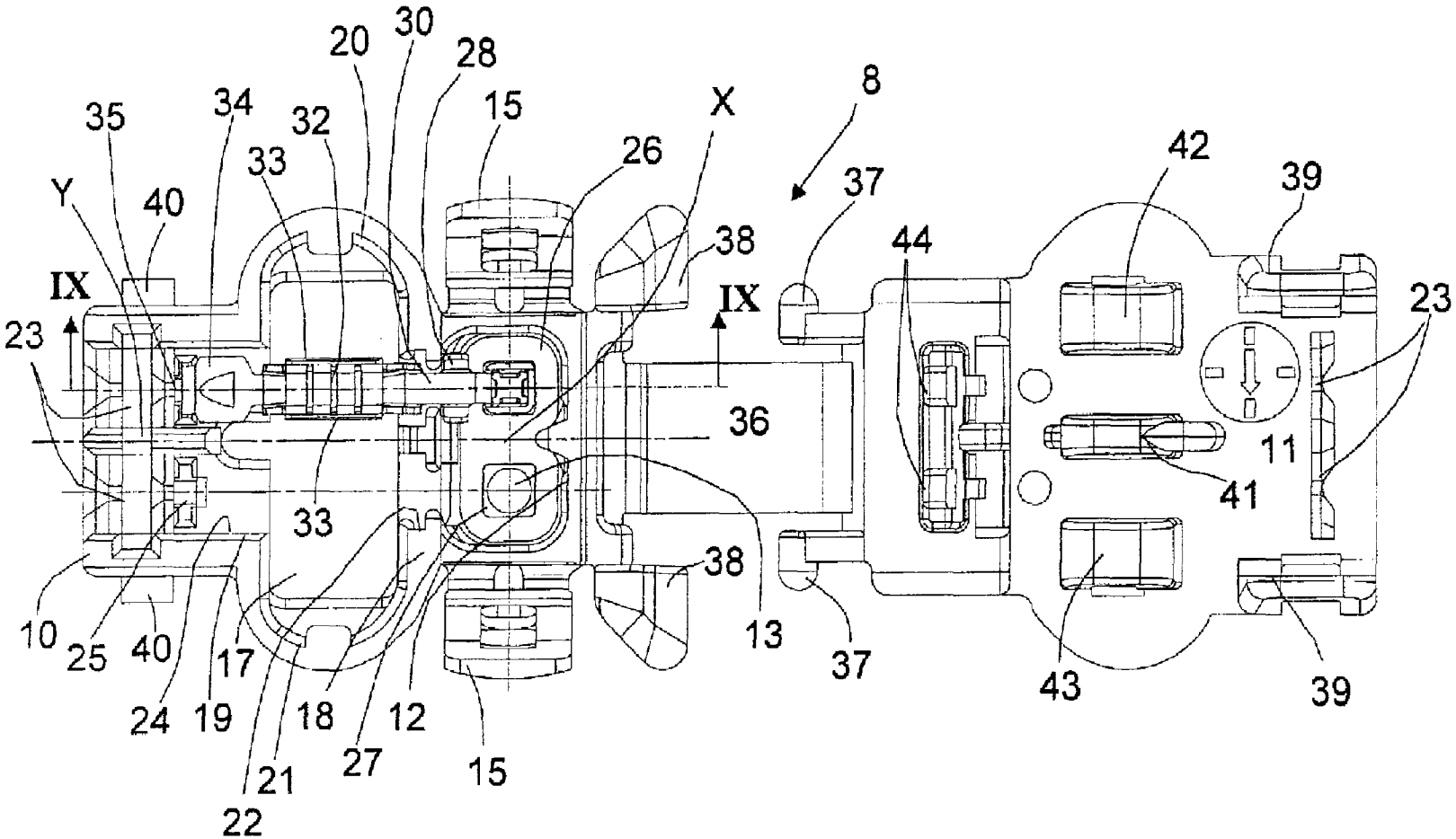
Figure 9:
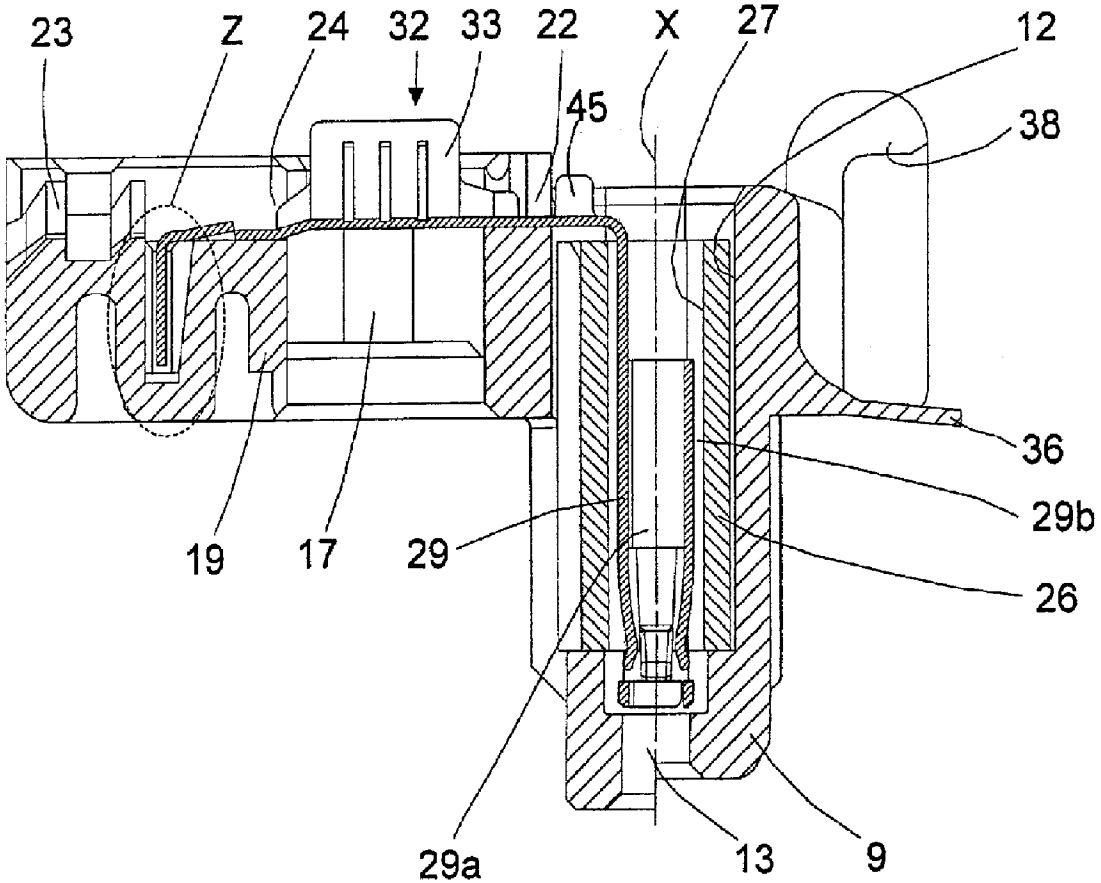
Figure 10:
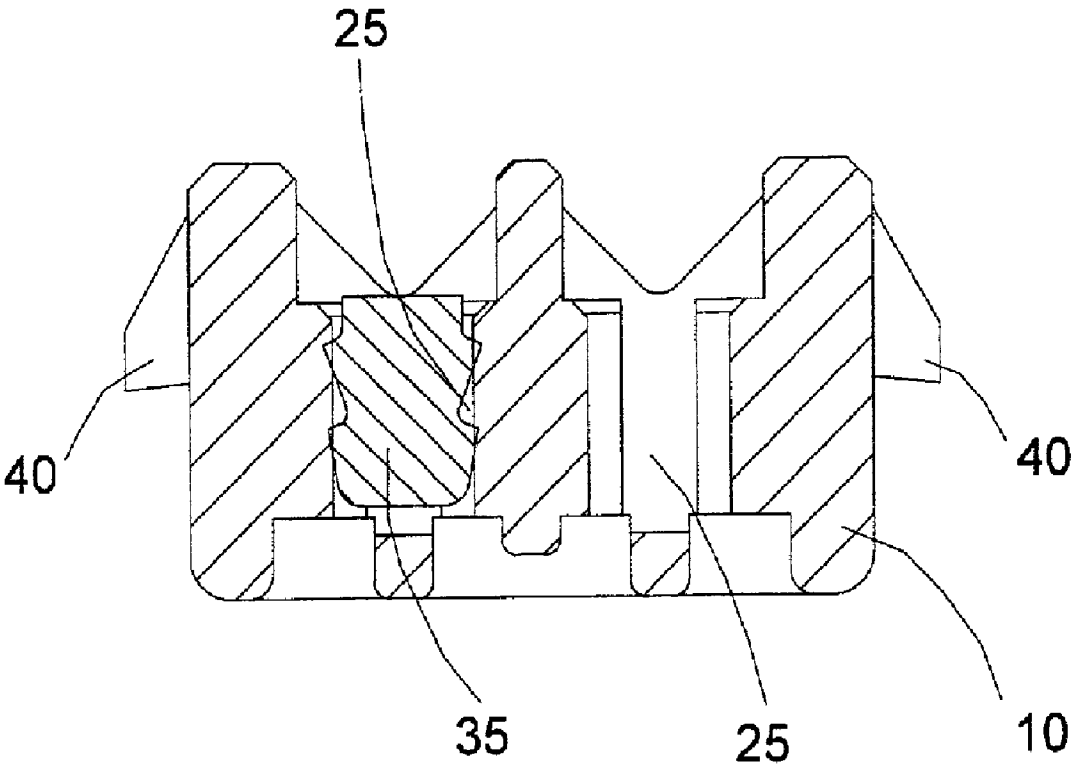
Figure 11:
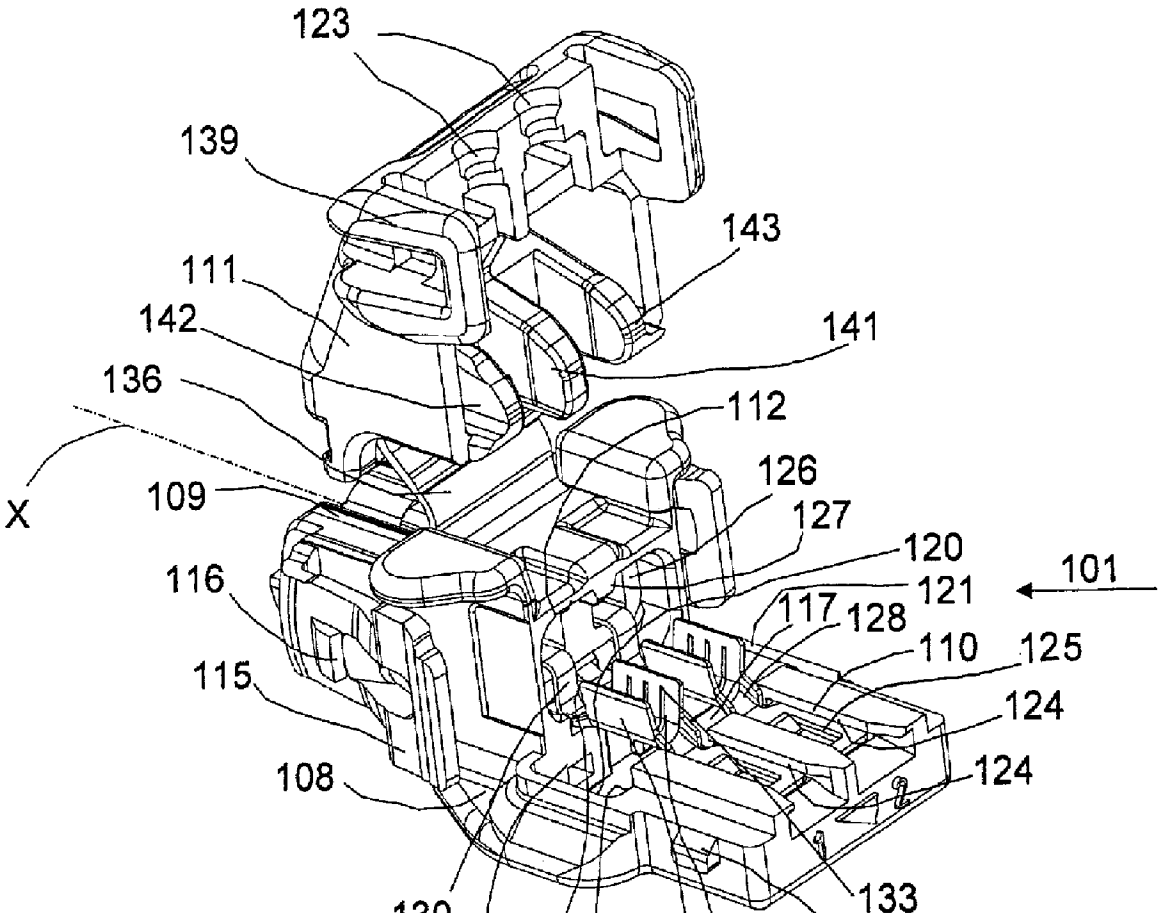
Figure 12:
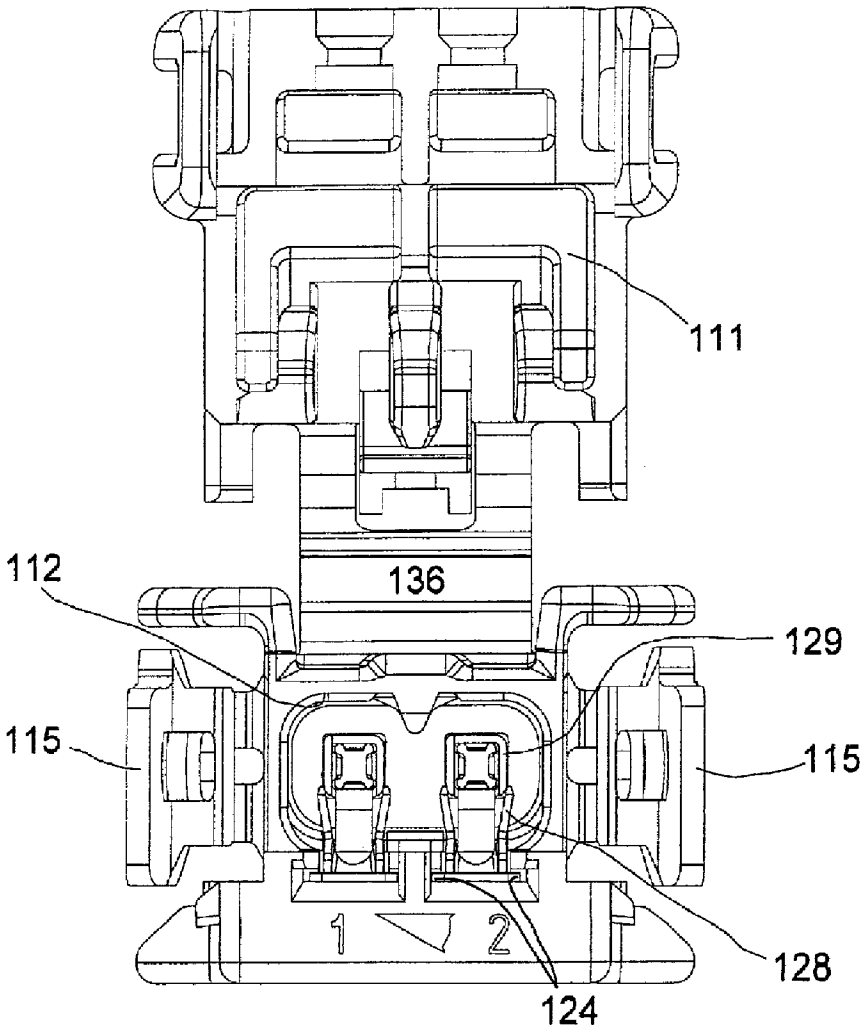
Figure 13:
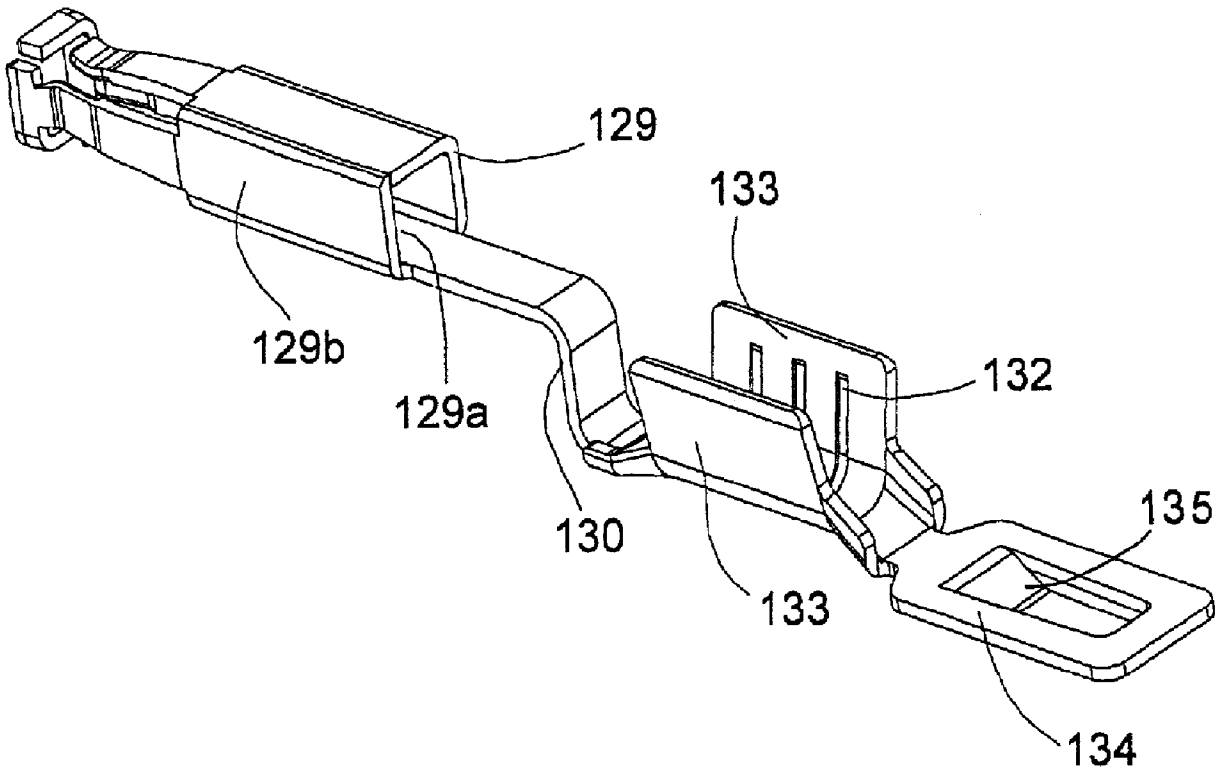

FIG. 1 a perspective view of a first embodiment of a connector according to the invention, FIG. 2 a sectional view II—II of FIG. 3, FIG. 3 a sectional view III—III of FIG. 1, wherein, however, the cutting plane is rotated by 180°, FIG. 4 a contact element of the connector of FIGS. 1 to 3 as a detail in a first view, FIG. 5 a plan view of FIG. 4, FIG. 6 a sectional view through a ferrite element, as it is used in connection with the embodiment of FIGS. 1 to 5, FIG. 7 a side view to FIG. 6, wherein, however, the female terminal portion of the contact element of FIGS. 4 and 5 is, additionally, shown, FIG. 8 a view onto the connector with the lid opened, FIG. 9 a sectional view IX—IX of FIG. 8, FIG. 10 the detail Z of FIG. 9, FIG. 11 a perspective view of a second embodiment of a connector according to the invention, FIG. 12 a top view of FIG. 11 and FIG. 13 a perspective view of a contact element, as it is used in the embodiment of FIGS. 11 and 12.

In the following description of the first embodiment of a connector 1 it is referred to the FIGS. 1 to 10.

FIG. 1 is a perspective view of a connector 1 of a first embodiment according to the invention. This is to be connected to a mating connector 2, as it is visible from FIGS. 2 and 3. The mating connector 2 belongs for example to an aggregate of a vehicle, for example to the ignition device of an airbag-system.

The mating connector 2 defines an insertion chamber 3, into which contact pins 4 project and which represent the electrical conductive connection to the airbag-ignition system. In the insertion chamber 3 a retaining groove 5 is, furthermore, provided, which serves to fix the connector 1 to the mating connector 2.

The connector 1 according to the invention is connected at the end of a wire harness to the cables 6, which, respectively, comprise a conductor 7, as visible from FIG. 3. The connector 1 comprises a housing 8, which has an insertion portion 9, which is to be inserted into the insertion chamber 3 of the mating connector 2. Furthermore, the housing 8 comprises an open housing portion 10, which extends in an angled manner to the insertion portion 9 and into which end facing away from the insertion portion 9 the cables 6 are inserted. The open housing portion 10 can be closed by a lid 11, formed preferably on to the open housing portion 10 in the area of the insertion portion 9, so that the two form together a unit.

The insertion portion 9 forms a connection axis X, along which the insertion portion 9 of the connector 1 can be inserted into the insertion chamber 3 of the mating connector 2 or released therefrom, respectively.

In the insertion portion 9 an accommodation chamber 12, extending along the connection axis X, is arranged, at which end distanced from the open housing portion 10 two through openings 13 are arranged, through which, when connecting the insertion portion 9 of the connector 1 to the mating connector 2, the contact pins 4 can enter the accommodation chamber 12. The accommodation chamber 12 is open in the direction towards the open housing portion 10 of the connector 1.

On the insertion portion 9, which forms an essentially oval or rectangular cross-section transversally to the connection axis X, holding tabs 15 are formed on opposite side edges, which are provided close to their connection ends to the insertion portion 9 with retaining projections 14, which project away from the insertion portion 9 to the outside. The holding tabs 15 protrude beyond these retaining projections 14 towards the open housing portion 10 and form portions, which can be gripped by fingers for the actuation.

The holding tabs 15 are formed elastically. In the connected condition of the connector 1 to the mating connector 2, the retaining projections 14 engage in the retaining groove 5 such, that the holding tabs 15 are in the relaxed condition. The housing 9, together with the holding tabs 15 formed thereon, and the lid 11, formed thereon, is manufactured from an electrically insulating material, especially a resin.

The accommodation chamber 12 is formed open towards the open housing portion 10. At their end distanced to the through openings 13, one or more holding projections 16 are arranged, which project into the accommodation chamber 12 in the direction towards the connection axis X. In the open housing portion 10 in a portion off-set to the end of the open housing portion forming the introduction end for the cable 6, a through hole 17, which extends in the direction of the connection axis X through the open housing portion 10, is arranged, so that this is open in this area towards the mating connector 2 and away from the same and forms a through hole. This open through hole 17 is delimited, as especially visible from FIG. 8, by a first wall 18 arranged close to the accommodation chamber 12, a second wall 19, distanced to the accommodation chamber 12, a third wall 20, laterally connecting the two wall 18, 19, and a lateral fourth wall 21.

The first wall, arranged close to the accommodation chamber 12 in the insertion portion 9, has first holding means 22 in form of a holding recess.

The second wall 19 arranged distanced to the accommodation chamber 12 and extending approximately parallel to the first wall 18, forms third holding means 24 in form of a holding recess, which also as the first holding means 22 is open at the top (away from the insertion portion).

At the end of the open housing portion 10 distanced to the insertion portion 9, a portion of the second holding means 23 in form of grooves for accommodating and retaining the cable 6, entering the open housing portion 10, is arranged.

The housing 8 has in the area of the open housing portion 10, open at the top in direction to the end of the open housing portion 10, having the second holding means 23, two securing recesses 25. These are off-set to the transversal axis Y, forming the central axis of the open housing portion 10 and arranged on a common plane with the connection axis X and extending at a right angle to the connection axis X. The securing recesses 25 extend parallel off-set to the connection axis X through the open housing portion 10. The open housing portion 10 is closed by a lid, formed on the housing 8 close to the insertion portion 9 by interconnection of a connection tab 36, as described in more detail later.

The accommodation chamber 12 accommodates a cuboid ferrite element 26 which is generally rectangular, when seen in cross-section, and provided with rounded longitudinal edges. This ferrite element 26 is shown in FIG. 6 in a longitudinal sectional view and has two through holes 27, which are arranged off-set laterally in opposite direction to the connection axis X. This ferrite element 26 can also be constructed of several parts and is accommodated in the accommodation chamber 12 such, that its through holes 27 extend parallel to the connection axis X and are arranged laterally off-set to a plane formed by the connection axis X and the transversal axis Y and are, respectively, open to one of the through openings 13. The ferrite element 26 is held in the accommodation chamber 12 by the holding projection(s) 16.

In FIGS. 4 and 5 a contact element 28 from an electrically conductive material, for example a copper material, is shown. It is formed starting from a sheet material by means of punching and bending. It has a female terminal portion 29, formed in cross-section to an approximately square tubular component and which contact chamber is designated by 29*a*. Into the same one of the two contact pins 13 enters, as it is visible from FIG. 2. The female terminal portion 29 has the outer face 29*b*.

The female contact portion 29 extends in the assembled condition of the contact element 28 parallel to the connection axis X. Starting from a wall of the female terminal portion 29 a trip-like connection portion 30, which is bent at a right angle at a distance to the contact element 28, extends parallel to the connection axis X. This connection portion 30 has a portion with wings 45 projecting laterally, for holding the contact element 28 parallel to the transversal axis Y of the open housing portion 10 against pulling force acting on the mating cable 6, wherein the wings 45 can be supported on the first wall 18 in direction away from the female terminal portion 29. Furthermore, the side edges 31 serve for gripping into the wall of the holding recess 24 forming the first holding means 22 in the first wall 18. Following thereto, a connecting portion 32, comprising two crimping tabs 33, serving for crimping the conductor 7 of a cable 6 and which, as visible from FIG. 3, serve to produce an electrically conductive connection to the conductor 7, is arranged.

The end of the female terminal portion 29 facing away from the connection portion 30 forms an opening, which, in the assembled condition, is arranged opposite a through opening 13 and enables an entering of a contact pin 4 into the contact chamber 29*a*.

An extension portion 34, extending also approximately parallel to the transversal axis Y, follows the connecting portion 32 away from the female terminal portion 29. Attached thereto and also again bent, a strip-like securing portion 35 is arranged, which extends parallel to the insertion portion 9 and which side edges are provided with a sawtooth-like serration. This is pressed into the mating securing recess 25 in the open housing portion 10 close to the second holding means 23, so that its serration engages in the material of the open housing portion 10, delimiting the securing recess 25 (see FIG. 10) and thus the contact element 28 is held against pulling forces, acting on the cable 6.

The female terminal portion 29 is accommodated in one of the two through holes 27 of the ferrite element 26 such, that its outer face 29*b* is arranged with a distance S at all sides to the wall of the through holes 27 (see FIG. 7). The extension portion 34 is retained with its side edges, as the part of the connection portion 34 having the side edges 31, by the engagement in the opposed walls of the holding recess forming the third holding means 24 in the open housing portion 10.

The female terminal portion 29 can be aligned laterally freely when connecting to the contact pin 4, so that the centring and connecting is facilitated.

The connector 1 comprises two of the above described contact elements 28. Their arrangement and attachment in the housing 8 and the arrangement to the ferrite element 26 are identical.

The lid 11 is connected via connecting tabs 36 forming a hinge integrally to the insertion portion 9 of the housing 8. At the end of the open lid 11 arranged close to the insertion portion 9, two holding journals 37 are arranged, which engage for connecting the lid 11 to the open housing portion 10, under the holding lugs 38 formed on the open housing portion 10.

On the end of the lid 11 distanced to the connection tab 36 two elastic securing arms 39 are formed on the side edges, which project in the direction to the open housing portion 10 and engages over its side edges. In this case, they engage, respectively, over a securing projection 40 of the open housing portion 10, so that the lid 11 is retained on the open housing portion 10. Thus, it secures with the means of the second securing means 23 assigned to it together with those on the open housing portion 10 the two cables 6, such that, it presses onto the insulation.

In the area of the lid 11, which is arranged opposite to the through hole 17 of the open housing portion 10, three distancing projections 41, 42, 43, engaging in the through hole 17, are arranged transversally to the transversal axis Y. The distancing projection 41 engages, in this case, between to two parallel connecting portions 32 of the two contact elements 28, off-set laterally to the transversal axis Y, so that these are isolated from each other. The two other distancing projections 42, 43 come to rest, respectively, between a lateral wall 20 or 21, respectively, and one of the contact elements 28, so that they are retained laterally. The through hole 17 serves for inserting a mating holder and a forming tool of a crimping tool for connecting the crimping tabs 33 to a conductor 7. The first and third holding means 22 or 24, respectively, hold the contact element 28 on the housing 8 in the direction of the transversal axis Y in front of and behind the through hole 17 and, thus, in front of and behind the connecting portion 32.

Additionally on the inner side of the lid 11, facing the open housing portion 10, a support projection 44 is arranged. This support projection 44 abuts a support face of the ferrite element 26 arranged to face the open housing portion 10, when this is arranged in the accommodation chamber 12 and when the lid 11 is closed and is arranged opposed to the bent portion of the connection portion 30 of the contact element 28. Thus the contact elements 28 as well as the ferrite element 26 are supported, when inserting the connector 1 with its insertion portion 9 into the insertion chamber 3, and connecting to the contact pins 4.

For reasons of simplification only one contact element 8 is shown in FIGS. 1 to 10, arranged to the housing 8.

Concerning the embodiment of a connector 108 according to FIGS. 11 and 12, the description of FIGS. 1 to 10 is essentially valid, wherein, however, for corresponding components or portions reference numerals are used, which numerical values are increased by the numerical value 100 compared to those of FIGS. 1 to 10.

The difference resides essentially, in that the open housing portion 108 is not angled in relation to the insertion portion 109, but extends also in the direction of the connection axis X. Correspondingly the connecting portion 132 and the extension portion 134 extend parallel to the connection axis X.

From the extension portion 134 a tongue is stamped, which forms a securing portion 135, which is cranked to the remaining part of the extension portion 134 and engages in a securing recess 125 arranged below the extension portion 134 in the mounted condition in the open housing portion 110. The third holding means 124 are represented by grooves arranged laterally above the securing recess 125 and in which the extension portion 134 engages with its side edges or are represented by the securing recess 125. The grooves extend parallel to the transversal axis Y.

The invention claimed is:

1. Connector (1, 101) for airbag-ignition systems and for insertion into an insertion chamber (3) of a mating connector (2) with contact pins (4) and for detaching therefrom along a connection axis (X), comprising two contact elements (28, 128) from an electrically conductive material, which, respectively, have a female terminal portion (29, 129) with an outer face (29*b*, 129*b*), which serves to connect a contact pin (4) of the mating connector (2) along the connection axis (X), have a connecting portion (32, 132) for connecting to a conductor (7) of a cable (6) and a connection portion (30, 130), connecting the female terminal portion (29, 129) to the connecting portion (32, 132), a ferrite element (26, 126), which consists of one or more connected components, has two through holes (27, 127), accommodating, respectively, the female terminal portion (29, 129) of a contact element (28, 128) and leaving a gap (S) to the outer face (29*b*, 129*b*), a housing (8, 108) from an electrically insulating material, which has an insertion portion (9, 109) for insertion into the insertion chamber (3) of the mating connector (2), which forms an accommodation chamber (12, 112) for the ferrite element (26, 126) and which has through holes (13) for the contact pins (4), has an open housing portion (10, 110), closable by a lid (11, 111) and which for each contact element (28, 128) has at least one first holding means (22, 122), by which the connection portion (30, 130) of the contact element (28, 128) is retained, and has second holding means (23, 123) at the open housing portion (10, 110) and/or lid (11, 111), serving to hold a cable (6) including one or both conductors (7).

2. Connector according to claim 1, wherein the first holding means (22, 122) and/or the third holding means (24, 124) are formed as holding recesses.

3. Connector according to claim 1, wherein wings (45), projecting laterally from the connection portion (30), abut the wall (18) of the holding recess (24), accommodating the connection portion (30).

4. Connector according to claim 1, wherein the connecting portion (32, 132) comprises crimping tabs (33, 133).

5. Connector according to claim 1, wherein the accommodation chamber (12, 112) for accommodating the ferrite element (26, 126) is accessible for inserting the ferrite element (26, 126) from the open housing portion (10, 110).

6. Connector according to claim 1, wherein the lid (11, 111) is retained by securing projections (40, 140) and securing arms (39, 139) on the housing (8, 108).

7. Connector according to claim 1, wherein the lid (11, 111) is manufactured integrally with the housing (8, 108).

8. Connector according to claim 1, wherein the insertion portion (9, 109) of the housing (8, 108), elastic holding tabs (15, 115) with respectively one holding projection (16, 116) are formed, serving for retaining the connector (1, 101) on the mating connector (2).

9. Connector according to claim 1, wherein the lid (11) holds the ferrite element (26) in the accommodation chamber (12).

10. Connector according to claim 1, wherein the insertion portion (9) of the housing (8) is angled relative to the open housing portion (10) and that correspondingly the connection portion (30), the connecting portion (32) and the extension portion (34) of the contact elements (28) are bent in accordance therewith relative to the female terminal portion (29).

11. Connector according to claim 1, wherein the extension portion (34, 134) has at least one securing portion (35, 135), which engages a securing recess (25, 125) of the open housing portion (10, 110) forming the third holding means (24, 124).

12. Connector according to claim 11, wherein the extension portion (134) has at least one securing portion (135), which is formed by a tab punched from the extension portion (134) and cranked to it, and which engages in the assembled condition a securing recess (125) arranged be-low the extension portion (134) in the open housing portion (110) and which forms the third holding means (124).

13. Connector according to claim 12, wherein the extension portion (134) is retained by third holding means (124) of the open housing portion (110), which are formed as recesses.

14. Connector according to claim 11, wherein the securing portion (35) is bent at a right angle to the extension of the extension portion (34), of the connection portion (30) and of the connecting portion (32).

15. Connector according to claim 14, wherein the connection portion (30) and/or the extension portion (34) grip with their side edges or claws attached thereto, respectively, into one of the two opposed wall portions, which delimit the mating holding recess, for the retainment.

16. Connector according to claim 1, wherein the connecting portion (32, 132) is arranged in an open through hole (17, 117) of the open housing portion (10, 110).

17. Connector according to claim 16, wherein the lid (11, 111) has three distancing projections (41, 42, 43; 141, 142, 143), which engage in the through hole (17, 117), of which one (41, 141) is arranged between the connecting portions (32, 132) of the two contact elements (28, 128) and the two others (42, 43; 142, 143) are, respectively, arranged between one connecting portion (32, 132) and one of the lateral walls (20, 21) of the through hole (17, 117).

18. Connector (1, 101) for airbag-ignition systems, for insertion into an insertion chamber (3) of a mating connector (2) with contact pins (4) and for detaching therefrom along a connection axis (X), comprising two contact elements (28, 128) from an electrically conductive material, which, respectively, have a female terminal portion (29, 129) with an outer face (29*b*, 129*b*), serving for connecting to a contact pin (4) of the mating connector (2) along the connection axis (X), have a connecting portion (32, 132) for connecting to a conductor (7) of a cable (6) and have a connection portion (30, 130), connecting the female terminal portion (29, 129) to the connecting portion (32, 132), have away from the connection portion (30, 130) following the connecting portion (32, 132) an extension portion (34, 134), a housing (8, 108) from an electrically insulating material, which has an insertion portion (9, 109) for inserting into the insertion chamber (3) of the mating connector (2), having through openings (13) for the contact pins (4), has an open housing portion (10, 110), closable by a lid (11, 111) and which has for each contact element (28, 128) at least one first holding means (22, 122), by which the connection portion (30, 130) of the contact element (28, 128) is retained, has second holding means (23, 123) at the open housing portion (10, 110) and/or lid (11, 111), serving to hold at least one cable (6), and has third holding means (24, 124) at the open housing portion (10, 110), at which third holding means (24, 124) the extension portion (34, 134) is retained.

19. Connector according to claim 18, wherein a ferrite element (26, 126) is provided, which consists of one or more connected components, the ferrite element (26, 126) has two through holes (27, 127), which, respectively, accommodate the female terminal portion (29, 129) of a con-tact element (28, 128) and leave a gap (S) to the outer face (29*b*, 129*b*), and the insertion portion (9, 109) of the housing (8, 108) forms an accommodation chamber (12, 112) for the ferrite element (26, 126).

* * * * *